US005586454A

United States Patent [19]

Matsuda et al.

[11] Patent Number: 5,586,454

[45] Date of Patent: Dec. 24, 1996

[54] WARP-KNIT TAPE FOR SLIDE FASTENER

[75] Inventors: Yoshio Matsuda; Hidenobu Kato, both of Toyama-ken, Japan

[73] Assignee: YKK Corporation, Tokyo, Japan

[21] Appl. No.: 519,403

[22] Filed: Aug. 25, 1995

[30] Foreign Application Priority Data

Aug. 26, 1994 [JP] Japan ..... 6-202259

[51] Int. Cl.[6] ..... A44B 19/34; D04B 21/00

[52] U.S. Cl. ..... 66/193; 66/195; 24/393

[58] Field of Search ..... 66/190, 192, 193, 66/195, 196; 24/393, 398

[56] References Cited

U.S. PATENT DOCUMENTS

| | | | |
|---|---|---|---|
| 3,842,628 | 10/1974 | Bennett et al. | 66/193 |
| 4,051,579 | 10/1977 | Heimberger | 66/195 X |
| 4,190,935 | 3/1980 | Matsuda | 66/195 X |
| 4,265,003 | 5/1981 | Matsuda | 66/193 X |
| 4,378,683 | 4/1983 | Matsuda et al. | 66/193 |
| 4,498,316 | 2/1985 | Matsuda | 66/193 X |
| 5,457,968 | 10/1995 | McClintock et al. | 66/192 X |

FOREIGN PATENT DOCUMENTS

| | | | |
|---|---|---|---|
| 2103774 | 8/1972 | Germany | 66/193 |

*Primary Examiner*—John J. Calvert

*Attorney, Agent, or Firm*—Hill, Steadman & Simpson

[57] ABSTRACT

In a warp-knit tape for a slide fastener, an element-mounting edge portion comprises a reinforcing core, a double-face chain stitches knitted of two yarns on opposite sides of the core, a weft inlaid structure in which a plurality of weft yarns extending between and laid in the two chain stitches symmetrically on the front and back sides, and part of a ground knit structure of a tape web portion. The chain stitches are knitted alternately with the front and back sides of the element-mounting edge portin, and the symmetrical weft yarns are laid respectively in the front and back sides of the element-mounting edge portion. The web portion has a single-face knit structure knitted by the knitting needles on only one of the front and back sides. The resulting element-mounting edge portion has a substantially rectangular cross section.

5 Claims, 4 Drawing Sheets

WARP-KNIT TAPE FOR SLIDE FASTENER

BACKGROUND OF THE INVENTION

1. Field of the Invention

This invention relates to a warp-knit tape, for slide fasteners, in which an element-mounting edge portion is knitted simultaneously with a knit web portion so as to bulge along one longitudinal edge of the web portion.

2. Description of the Related Art

There are various types of warp-knit tapes for use known in the field of slide fasteners. For example, Japanese Utility Model Publication No. SHO 56-16088 discloses a warp-knit fastener tape which comprises a web portion knitted by knitting needles on only one of front and back sides of a multi-row-needle knitting machine, an element-mounting edge portion including double tricot stitches knitted by multiple rows of needles so as to surround a reinforcing core tightly, and a connecting portion extending between the web portion and the element-mounting edge portion and having double chain stitches knitted on both front and back sides also by multiple rows of needles. In the known fastener tape, the connecting portion has a great thickness compared with the web portion, and the element-mounting edge portion bulges uniformly from both the front and back sides of the connecting portion. With the resulting fastener tape, it is possible to mount fastener elements astride the element-mounting edge portion in a proper attaching posture and it is also possible to secure an adequate thickness of the tape portion to be clamped between opposite legs of the individual fastener elements so that the fastener elements can be attached to the tape reliably by clinching.

However, generally, the hollow to be defined between opposite legs of the individual fastener element attached to the fastener tape by clinching is substantially oval, and the oval-shape element portion is mounted astride the bulged tape portion with its distal ends gripping the web portion firmly.

Not only in the fastener tape disclosed in the above-mentioned prior art publication but in the conventional tape of this type, the cross-sectional shape of the element-mounting edge portion is substantially circular or oval in general. Accordingly, the inside surfaces of the opposite legs of the individual fastener elements act in only a limited gripping force such as to resiliently deform the element-mounting edge portion from circular into oval in cross section so that the degree of strength of attaching the elements to the tape chiefly depends on the gripping force of the distal ends of opposite element legs. Consequently, the coupling head of the individual fastener element tends to move longitudinally of the tape about the distal ends of the opposite element legs, thus obstructing smooth movement of a slider and causing a nonstable attaching posture of the fastener elements.

Further, since the cross section of the element-mounting edge portion of the fastener tape is circular or oval, it is difficult to mount, for example, a zigzag-shape row of synthetic resin fastener elements in a proper posture on an arcuate surface of the element-mounting edge portion when the fastener elements are sewn to the fastener tape.

SUMMARY OF THE INVENTION

It is therefore an object of this invention to provide a warp-knit tape, for slide fasteners, which has a thin web portion and secures a proper attaching posture of various types of metal and synthetic resin fastener elements so that the fastener elements can be attached to the tape firmly and stably.

According to this invention, the above object is accomplished by a warp-knit tape, for a slide fastener, comprising: a web portion having a ground knit structure; and an element-mounting edge portion connected to and extending along the web portion; the element-mounting edge portion being composed of a reinforcing core, double chain stitches respectively knitted of two knitting yarns respectively extending on opposite sides of the reinforcing core, a weft inlaid structure of a plurality of weft inlaid yarns laid in and extending symmetrically in opposite directions between the double chain stitches on front and back sides, and part of the ground knit structure of the web portion, characterized that the double chain stitches are knitted alternately with the front side and back side of the element-mounting edge portion, while the symmetrical weft inlaid yarns are respectively knitted with the front side and back side of the element-mounting edge portion, and that the web portion is knitted by knitting needles only on either of the front side or the back side.

Preferably, in the double chain stitches, one of the front and back sides of the element-mounting edge portion is an open stitch and the other side of the element-mounting edge portion is a closed stitch. Further, the ground knit structure of the web portion is in the form of a single knit structure composed of chain stitches, tricot stitches and a weft inlaid structure, and the part of the ground knit structure of the web portion forming the element-mounting edge portion is composed of tricot stitches and weft inlaid structure. Furthermore, the warp-knit tape is preferably knitted simultaneously with a companion tape, and the confronting element-mounting edge portions of such opposite tapes are connected by a weft yarn of low-melting-point synthetic resin.

The web portion is in the form of a thin single knit structure, and the element-mounting edge portion is composed of the reinforcing core and double chain stitches extending on both front and back sides of the reinforcing core to form opposite wales. The two wales are connected and tightened by the weft inlaid yarns on the front and back sides, forming a bulged section of a generally rectangular cross section. By selecting the size of the yarn to be used as the reinforcing core and the size of the yarns to be used as the chain stitches, it is possible to obtain a desired size of bulged section required to attach the elements to the tape with adequate firmness.

When mounting the legs of the metal fastener elements astride the element-mounting edge portion, the shape of the inside surface of the individual leg is generally oval. Whereas in the warp-knit tape of this invention, since the cross-sectional shape of the element-mounting edge portion is generally rectangular, the legs of the individual element bite the corners of the edge portion so that the fastener tape is firmly gripped by the entire legs of the element, thus preventing the elements from lateral displacement and, at the same time, securing the elements to the fastener tape firmly. At that time, since the hook-shape ends of the element legs are in engagement with the steps of the bulged section, the elements can hardly be removed from the fastener tape.

Given that the cross-sectional shape of the bulged section of the element-mounting edge portion is rectangular, it is possible to enable, in addition to the foregoing functions, a smooth attachment of, for example, a top end stop, an insertion pin, a box pin or a box, and a zigzag-shape row of synthetic resin elements to the fastener tape in a stable posture, as compared with the oval cross-sectional shape of the bulged section.

Further, when a pair of fastener tapes are simultaneously knitted and connected by a connecting yarn of thermoplastic synthetic resin, it is possible to mold synthetic resin elements simultaneously and correctly on the opposite fastener tapes. During the molding, the connecting yarn is melted in the knit structure of the element-mounting edge portion due to the molding heat, making the element-mounting edge portion very stable.

DETAILED DESCRIPTION OF THE PREFERRED EMBODIMENT

A typical embodiment of this invention will now be described in detail with reference to the accompanying drawings.

Figure 1:
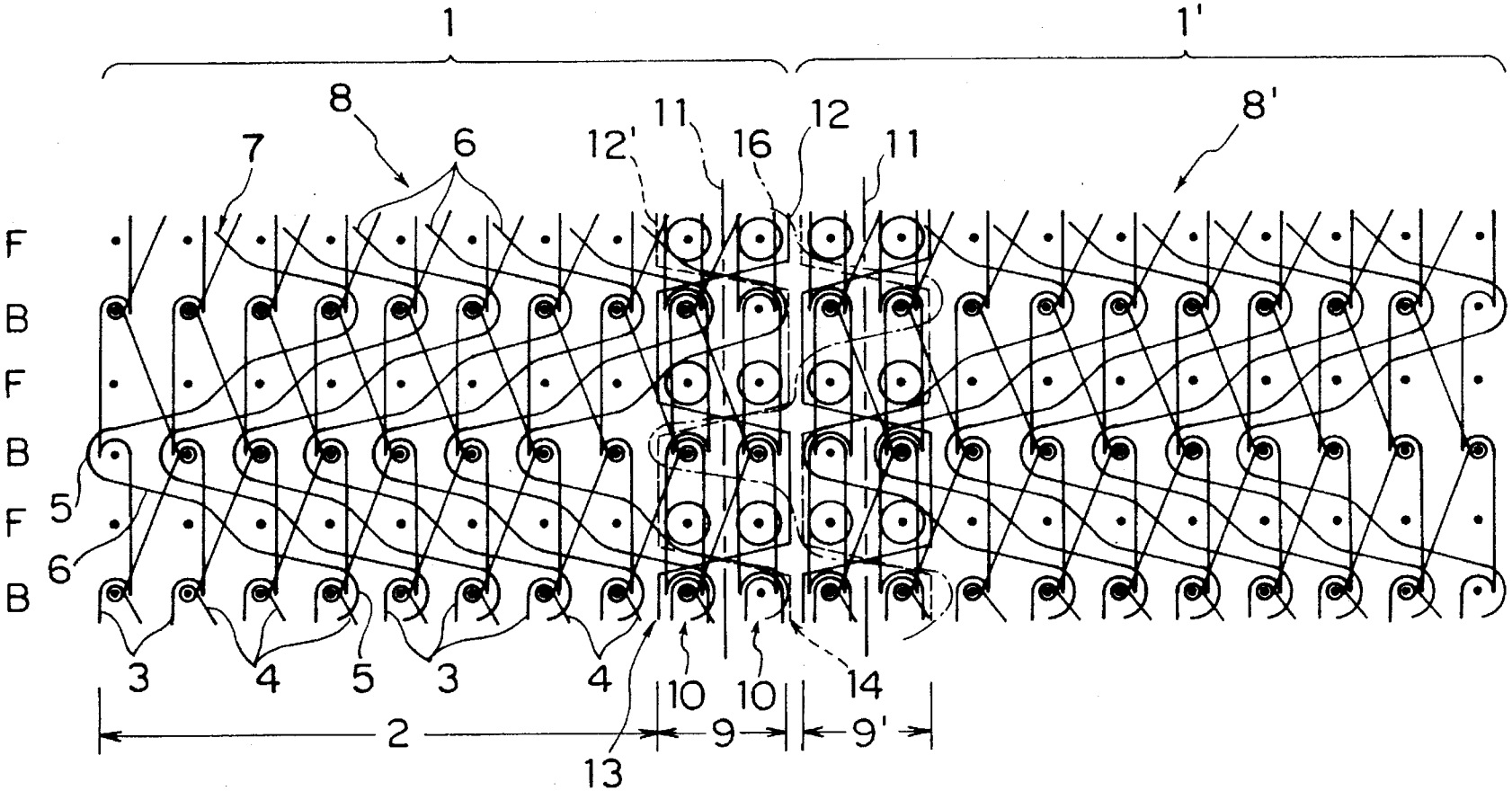
FIG. 1 is a diagram showing the structure of a warp-knit tape, for a slide fastener, according to a typical embodiment of this invention.

FIG. 1 shows a knit structure of a warp-knit tape 1, for a slide fastener, (hereinafter called the warp-knit fastener tape) according to this invention.

The warp-knit tape 1 is knitted on a double-face knitting machine equipped with a front row of needles (hereinafter called the front needles) F and a back row of needles (hereinafter called the back needles) B. A web portion 2 of the warp-knit fastener tape 1 has a single-face knit structure, and an element-mounting edge portion 9 of the warp-knit fastener tape 1 has a double-face knit structure having a reinforcing core 11 at the center and symmetrical on front and back sides with respect to the reinforcing core 11.

According to the embodiment of FIG. 1, the web portion 2 is knitted by the back needles B and has a ground knit structure 8 composed of chain stitches 3 and tricot stitches 4 knitted contiguously to the chain stitches 3 and having a knitting pattern of 1/1. The ground knit structure 8 further has a first weft inlaid structure 7 in which a plurality of weft yarns 6 laid in so as to form turns in different courses, thereby connecting the individual wales. On the other hand, the element-mounting edge portion 9 has a double-face knit structure connected with part of the ground knit structure 8 of the web portion 2 and includes a pair of opposite chain stitches 10 knitted respectively on front and back sides, the reinforcing core 11 laid in between the opposite wales of the chain stitches 10, and a second weft inlaid structures 13, 14 in which two weft yarns 12, 12' are laid in over a pair of wales on the front and back sides respectively and turn over symmetrically on the front and back sides.

Figure 3A:
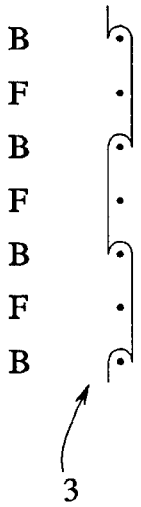
FIGS. 3(A), 3(B) and 3(C) are diagrams showing a knit structure of a web portion of the warp-knit tape.
Figure 3B:
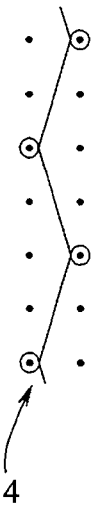
Figure 3C:
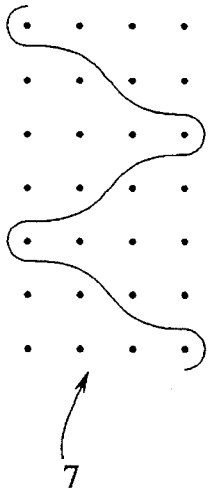
Figure 4A:
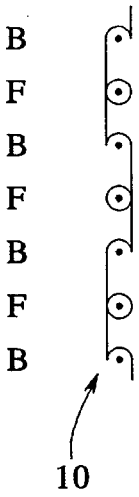
FIGS. 4(A), (B), (C) and 4(D) are diagrams showing a knit structure of an element-mounting edge portion of the warp-knit tape.
Figure 4B:
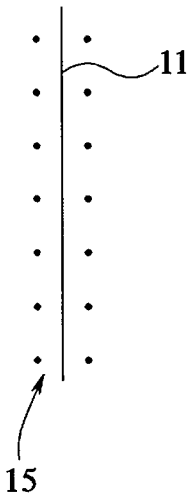
Figure 4C:
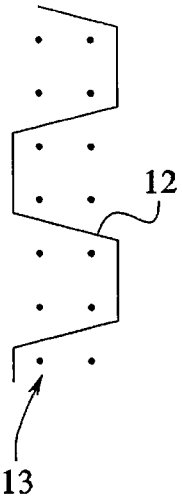
Figure 4D:
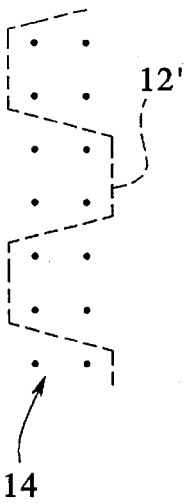

FIGS. 3(A), 3(B) and 3(C) show the chain stitches 3, the tricot stitches 4 and the first weft inlaid structure 7, respectively, of the web portion 2 knitted by the back needles B. The chain stitches 3 and the tricot stitches 4 are knitted in an open stitch pattern of 2-0/0-0/0-2/2-2 and in a closed stitch pattern of 2-4/2-2/2-0/2-2 respectively, and the weft yarns 6 of the first weft inlaid structure 7 are laid in a pattern of 0-4/4-4/8-8/4-4. The ground knit structure 8 should by no means be limited to the illustrated example and may be any other form to be used in a warp-knit fastener tape having a different single-face structure.

FIGS. 4(A), 4(B), 4(C) and 4(D) show the chain stitches 10, a core inlaid structure 15, the front-side second weft inlaid structure 13, and the backside second weft inlaid structure 14, respectively, of the element-mounting edge portion 9 knitted by multiple rows of needles. In the illustrated embodiment, the chain stitches 10 are knitted of a single weft yarn in a knitting pattern of 0-2/2-0/2-0/0-2 so as to form alternately an open stitch and a closed stitch by the front needles F and the back needles B. The chain stitches 10 form two wales between which the reinforcing core 11 laid in a pattern of 0-0/0-0/0-0/0-0 to form a core inlaid structure 15. At the same time, the yarns of both the tricot stitches 4 and the first weft inlaid structure 7, which constitute part of the ground knit structure 8, are knitted in the chain stitches 10 by the back needles B. Further, simultaneously with the knitting of the yarns of part of the ground knit structure 8 in the element-mounting edge portion 9, the weft yarn 12 on the front side having the second weft inlaid structure 13 of 4-4/0-0/0-0/4-4 extends across the core 11 on the front side, and the weft yarn 12' on the back side having the second weft inlaid structure 14 of 0-0/4-4/4-4/0-0 extends across the core 1 on the back side symmetrically with the weft yarn 12 on the front side. The weft yarns 12, 12' on the front and back sides are greater in size and tougher than the remaining weft yarns.

According to the illustrated embodiment, a pair of fastener tapes 1, 1' are simultaneously knitted with their element-mounting edge portions 9, 9' confronting each other. During the knitting, one of the weft yarns used in the first weft inlaid structure 7 partly constituting the ground knit structures 8, 8' of the opposite tapes 1, 1' is laid in and connects the tapes 1, 1' together. The connecting yarn designated as 16 is made of a low-melting-point synthetic resin.

Figure 2:
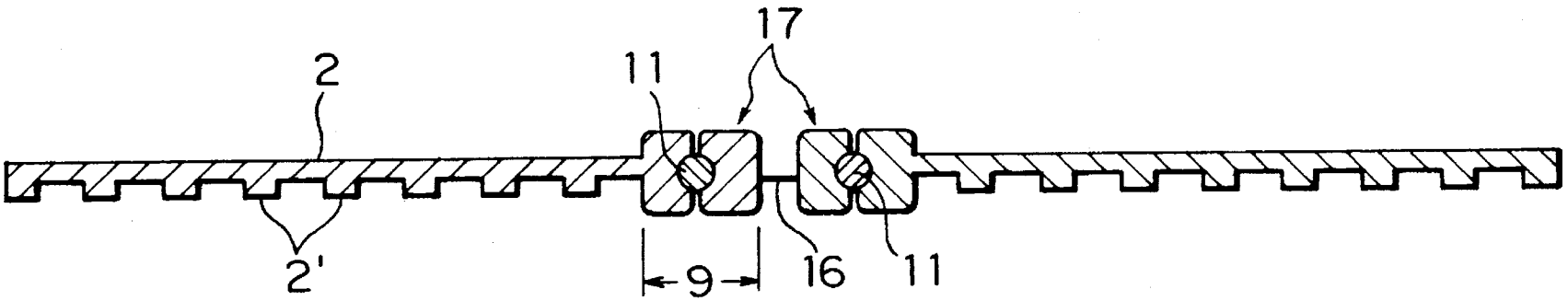
FIG. 2 is a transverse cross-sectional view showing a pair of the warp-knit tapes knitted simultaneously.

In the warp-knit fastener tape 1, as shown in FIG. 2, the web portion 2 has a thin single-face knit structure with wales 2' bulging on only the back side thereof, and the element-mounting edge portion 9 has the reinforcing core 11 the center thereof and two wales of the chain stitches 10 bulging on each of the front and back sides, the two wales being tightened by the weft yarns 12, 12' on the front and back sides to form a bulged portion 17 having a generally rectangular cross-sectional shape. By selecting a desired size for each of the core 11 and the yarns of the chain stitches 10, it is possible to obtain a desired size of bulged section 17 required to attach the elements to the tape with adequate firmness.

Figure 5:
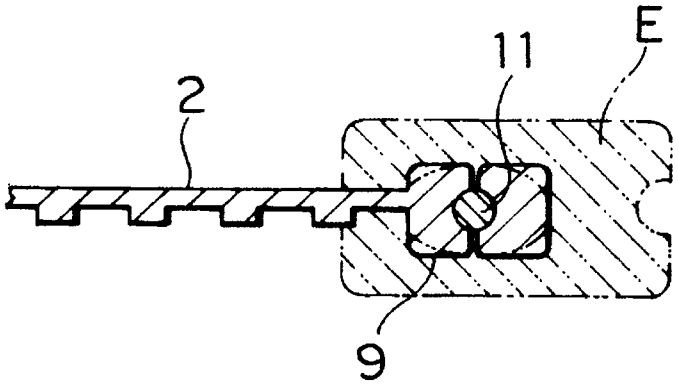
FIG. 5 is a transverse cross-sectional view showing the manner in which metal fastener elements are mounted on the warp-knit tape.

When mounting the legs of the metal elements astride the element-mounting edge portion 9, the inside surface of the individual leg is generally oval. On the other hand, in the warp-knit tape 1 of this invention, since the cross-sectional shape of the element-mounting edge portion 9 is generally rectangular, the legs of the individual element E bite the corners of the edge portion 9 so that the fastener tape 1 is firmly gripped by the entire legs of the element E, as shown in FIG. 5, thus preventing the elements E from lateral displacement and, at the same time, securing the elements E to the fastener tape 1 firmly. At that time, since the hook-shape ends of the element legs are in engagement with the steps of the bulged section 17, the elements E can hardly be removed from the fastener tape 1.

Given that the cross-sectional shape of the bulged section 17 of the element-mounting edge portion 9 is rectangular, it is possible to enable, in addition to the foregoing functions, a smooth attachment of, for example, a top stop, an insertion pin, a box pin or a box, and a zigzag-shape row of synthetic resin elements E to the fastener tape 1 in a stable posture, as compared with the oval cross-sectional shape of the bulged section 17.

Figure 6:
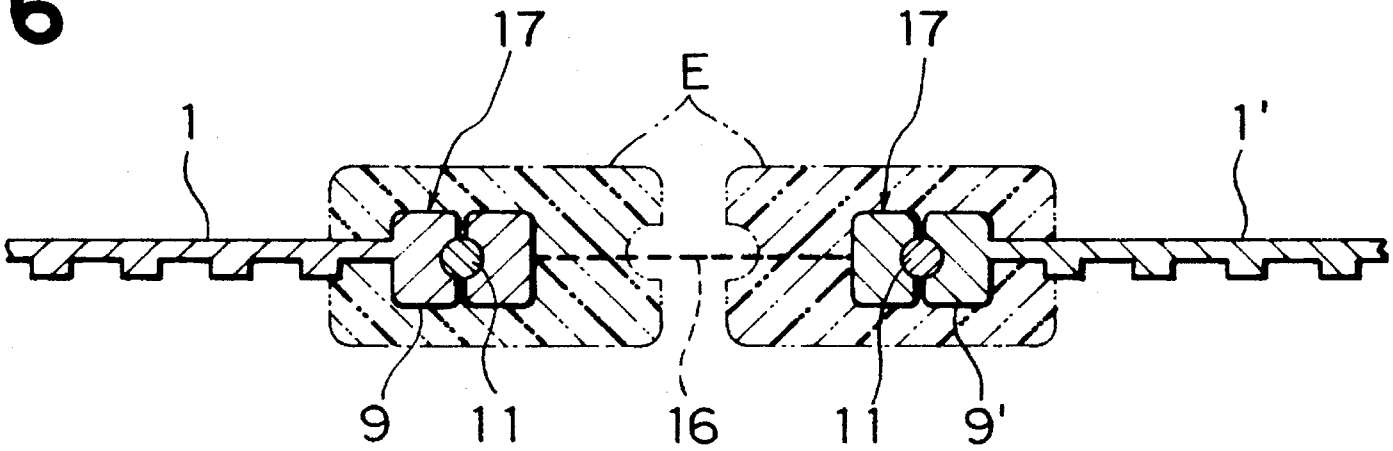
FIG. 6 is a transverse cross-sectional view showing the manner in which synthetic resin fastener elements are molded on opposite warp-knit tapes knitted simultaneously.

Further, when a pair of fastener tapes 1, 1' are simultaneously knitted and connected by a connecting yarn 16 of thermoplastic synthetic resin, it is possible to mold synthetic resin elements E simultaneously and correctly on the opposite fastener tapes 1, 1' as shown in FIG. 6. During the molding, the connecting yarn 16 is melted in the knit structure of the element-mounting edge portion 9 due to the molding heat, making the element-mounting edge portion 9 very stable.

As is apparent from the foregoing description, according to the warp-knit fastener tape 1 of this invention, since the element-mounting edge portion 9 knitted in a double-face knit structure by multiple rows of needles has a generally rectangular cross section bulging from both the front and back sides of the web portion 2, it is possible to attach various kinds of elements E easily in a proper posture to the tape 1. Particularly in attaching the metal elements E, the entire legs of the individual element E grip the tape 1 reliably and firmly with the leg ends engaging the bulged portion 17 having a rectangular so that the individual elements E are perfectly prevented from being removed from the tape 1. Further, since the web portion 2 knitted in a single-face knit structure with the element-mounting edge portion 9 knitted by multiple rows of needles, the web portion 2 is thin so that the tape 1 can be attached to a delicate product, such as underwear, giving a neat and smooth touch.

What is claimed is:

1. A warp-knit tape, for a slide fastener, comprising:

(a) a web portion having a ground knit structure; and (b) an element-mounting edge portion connected to and extending along said web portion;

(c) said element-mounting edge portion being composed of a reinforcing core, double chain stitches knitted of two knitting yarns respectively extending on opposite sides of said reinforcing core, a weft inlaid structure of a plurality of weft inlaid yarns laid in and extending symmetrically in opposite directions between said double chain stitches on front and back sides, and part of said ground knit structure of said web portion, said double chain stitches forming two wales with said reinforcing core laid therebetween;

(d) said double chain stitches being knitted alternately with the front side and back side of said element-mounting edge portion, said symmetrical weft inlaid yarns being knitted with the front side and back side of said element-mounting edge portion respectively;

(e) said web portion being knitted by knitting needles only on either of the front side or back side.

2. A warp-knit tape, for a slide fastener, according to claim 1, wherein in said double chain stitches, one of the front and back sides of said element-mounting edge portion is an open stitch and the other side of said element-mounting edge portion is a closed stitch.

3. A warp-knit tape, for a slide fastener, according to claim 1, wherein said ground knit structure of said web portion is in the form of a single knit structure composed of chain stitches, tricot stitches and a weft inlaid structure.

4. A warp-knit tape, for a slide fastener, according to claim 1, wherein the part of said ground knit structure of said web portion forming said element-mounting edge portion is composed of tricot stitches and weft inlaid structure.

5. A warp-knit tape, for a slide fastener, according to claim 1, wherein said warp-knit tape is knitted simultaneously with a companion tape, and the confronting element-mounting edge portions of such opposite tapes are connected by a weft yarn of low-melting-point synthetic resin.

* * * * *